United States Patent [19]

Marthinsen

[11] Patent Number: 4,738,566

[45] Date of Patent: Apr. 19, 1988

[54] ICE DEFLECTOR

[75] Inventor: Arve Marthinsen, Ski, Norway

[73] Assignee: Aker Engineering A/S, Oslo, Norway

[21] Appl. No.: 840,909

[22] Filed: Mar. 18, 1986

[30] Foreign Application Priority Data

Mar. 27, 1985 [NO] Norway ..... 851245

[51] Int. Cl.[4] ..... E02B 17/00

[52] U.S. Cl. ..... 405/217; 114/41; 114/219; 405/211

[58] Field of Search ..... 405/211, 212, 217, 213, 405/214, 215; 114/40, 41, 42, 219; 267/8 R, 137, 139; 104/250–259

[56] References Cited

U.S. PATENT DOCUMENTS

| | | | |
|---|---|---|---|
| 876,170 | 1/1908 | Grant | 405/213 |
| 1,077,508 | 11/1913 | Bell | 405/211 |
| 2,517,978 | 8/1950 | Collier | 114/41 |
| 2,842,939 | 7/1958 | D'Auriac | 405/214 |
| 3,005,435 | 10/1961 | Roach | 405/213 X |
| 3,173,270 | 3/1965 | Blancato | 104/254 X |
| 3,552,131 | 1/1971 | Mott et al. | 405/210 |
| 3,564,858 | 2/1971 | Pogonowski | 405/214 X |
| 3,572,273 | 3/1971 | Wood | 114/40 |
| 3,585,958 | 6/1971 | Naczkowski | 405/215 X |
| 3,602,151 | 8/1971 | Walker | 104/256 |
| 3,929,083 | 12/1975 | Blankenship et al. | 114/40 |
| 4,046,361 | 9/1977 | Morse | 267/139 |
| 4,069,783 | 1/1978 | Morgan | 114/42 |
| 4,295,758 | 10/1981 | Yashima | 405/210 X |
| 4,352,596 | 10/1982 | Hammett | 405/211 |
| 4,497,593 | 2/1985 | Kramer | 405/215 X |
| 4,505,618 | 3/1985 | Yashima | 405/211 |
| 4,568,220 | 2/1986 | Hickey | 405/195 |
| 4,572,080 | 2/1986 | Williams et al. | 104/256 X |
| 4,662,790 | 5/1987 | Loire | 405/211 X |

FOREIGN PATENT DOCUMENTS

| | | | |
|---|---|---|---|
| 2514451 | 4/1983 | France | 405/211 |
| 739309 | 10/1955 | United Kingdom | 405/213 |
| 1015041 | 4/1983 | U.S.S.R. | 405/211 |

*Primary Examiner*—Dennis L. Taylor

*Attorney, Agent, or Firm*—Hedman, Gibson, Costigan & Hoare

[57] ABSTRACT

A semi-submersible oil platform comprising two pontoons (1), columns (2) extending up from the pontoons and supporting a deck structure (3), and stays (4) extending transversally of the pontoons between the columns (2), is provided with a plough-like protecting device (8) for diverting drifting objects, e.g. ice bodies which are not sufficiently large to be detected by radar, but which, nevertheless, could cause considerable damage to the horizontal stays (4) of the platform and the drill string.

17 Claims, 3 Drawing Sheets

ICE DEFLECTOR

The present invention relates to an arrangement in a semi-submersible oil platform, comprising two pontoons, columns extending up from the pontoons and supporting a deck structure, and possible stays extending transversally of the pontoons between at least some of the columns.

In drilling for natural resources like oil and gas in sub-arctic areas, drilling platforms of the so-called semi-submersible type may be used, which usually are maintained in place at the drilling site by means of anchors and anchor lines extending from the corners of the platform.

In some sub-arctic areas ice bodies following the ocean currents may be present. Ice bodies weighing more than 5,000 tons may usually be discovered by the radar system of the platform and one will then have sufficient time for moving the platform before a collision with the ice body takes place. Smaller ice bodies, for instance calves from ice bergs, detached sections of pack ice etc., cannot be discovered on radar and nor can they be spotted visually in darkness or bad weather in time to avoid collision with the platform. Such collisions may easily damage the transverse connecting stays of the platform or the drill string.

The object of the invention is to avoid such damage and, in addition, improve the available drilling time for the platform by reducing the number of necessary moves from the drilling site due to drifting ice bodies.

According to the invention this is obtained by an arrangement of the type mentioned above, where the characteristic feature is that, in order to deflect drifting objects, a plough-like protecting device is mounted between the pontoons at at least one of their ends. Ice bodies impacting against the protecting device will thus be guided out on one side or the other of the platform and pass without damaging the platform.

According to an advantageous embodiment of the invention, the protecting device is pivotaly supported in attachment points on the pontoons and is held in generally horizontal position by means of a stay extending between the protecting device and the deck structure, and preferably being pivotaly connected to these. Thus, in order to facilitate access by e.g. supply vessels or the like, the protecting device may be swung up when not in use. Furthermore, the draft of the forward portion of the protecting device may be somewhat adjusted by suitable pivoting.

The protecting device may advantageously be connected to the existing supporting structure of each pontoon via a base. This ensures a rugged structure which may be adapted to already existing platforms.

The base may advantageously be attached horizontally movable in rails on the pontoons and be connected to shock absorbing means. This makes it possible for the protecting device to absorb relatively strong impacts without damage to itself or the platform. When the bases are movably arranged, the stay connecting the forward part of the protecting device to the deck structure of the platform may be telescopingly arranged so that the protecting device can maintain its generally horizontal position during the impact movement. The stay may have a stopper limiting its maximum length, so that the protecting device assumes its correct position after having sprung back to its initial position following the impact.

According to an advantageous embodiment, the protecting device is movable vertically on the base for easy adaptation to varying draft of the platform and to the type and form of the drifting ice masses.

Furthermore, according to the invention it is suggested to construct the protecting device generally as a truss. This provides a relatively light and strong structure, and concurrently it may be sufficiently open to prevent the forces acting on it due to the sea movements from influencing the stability of the platform to any noticeable degree. It may also be of advantage to form the truss three-dimensional and highest at the front. It therefore will be able to function at different depths without being adjustable in the vertical direction.

Finally, according to the invention it is suggested to arrange the protecting device generally at the same level as the transverse stays of the platform.

For better understanding of the invention, it will be described more closely with reference to the exemplifying embodiments illustrated in the appended drawings, where FIG. 1 shows a section along the line I—I in FIG. 2;

Figure 1:
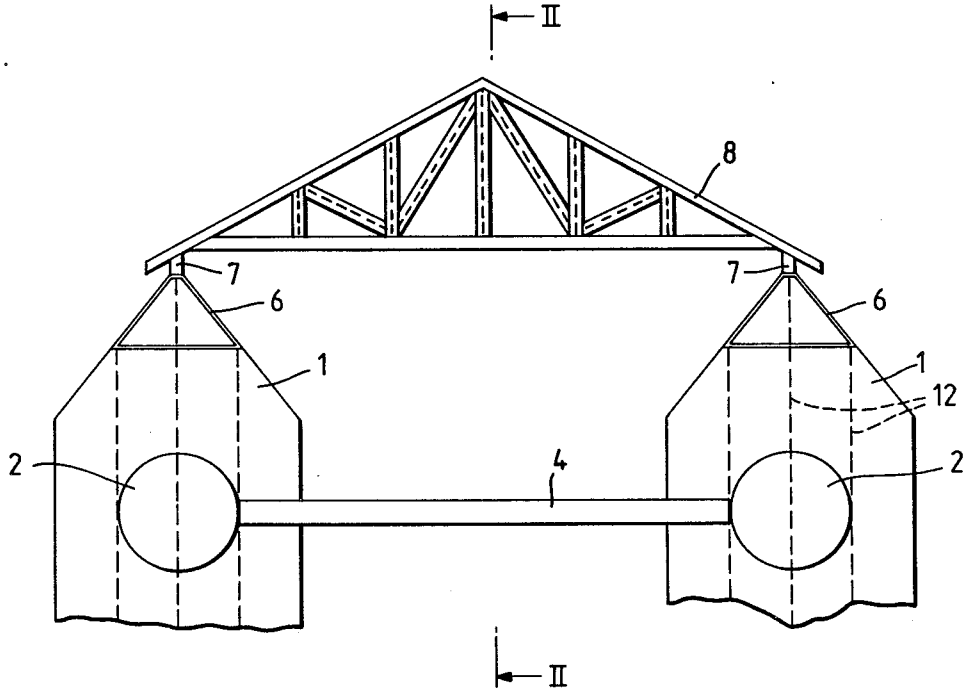
Figure 2:
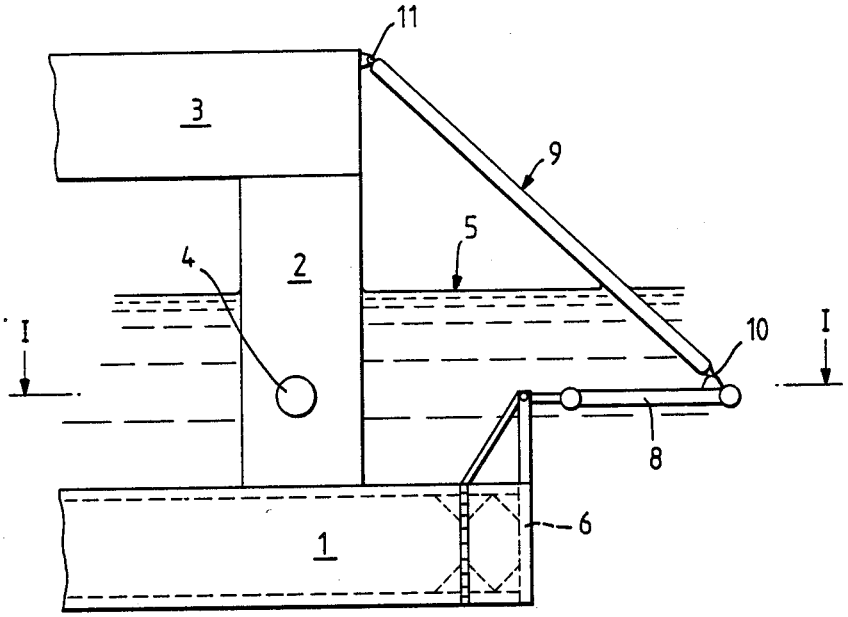
FIG. 2 shows a vertical section along the line II—II in FIG. 1.

The figures all show a part of a semi-submersible oil platform, which comprises two pontoons 1, wherefrom columns 2 extend upwards to support a deck structure 3. Transverse stays 4 extend between the columns 2, the stays being located under the water surface 5 in the normal working position of the platform.

Fore on each pontoon 1 a framework 6 is attached, which in turn serves as support for a joint 7. The ice deflector 8 itself is pivotably attached in the joints 7 and is constituted by a plough-formed, relatively open truss structure. The "plough" has a sufficiently acute top angle to effectively divert ice bodies and any other drifting objects that might impact against the deflector. The top angle may thus be about 120°.

When in use, the deflector 8 is held generally horizontal by means of a stay 9, which extends between the forward part of the deflector 8 and the deck structure 3 and is jointed to these at 10 and 11, respectively.

As best will be seen from FIG. 1, the deflector 8 is connected via the joints 7 to the existing supporting structure 12 of the pontoons via the framework 6. The joints 7 facilitates removing the deflector 8 for repair or replacement if it should be damaged or destroyed during a collision with a large ice body.

Figure 3:
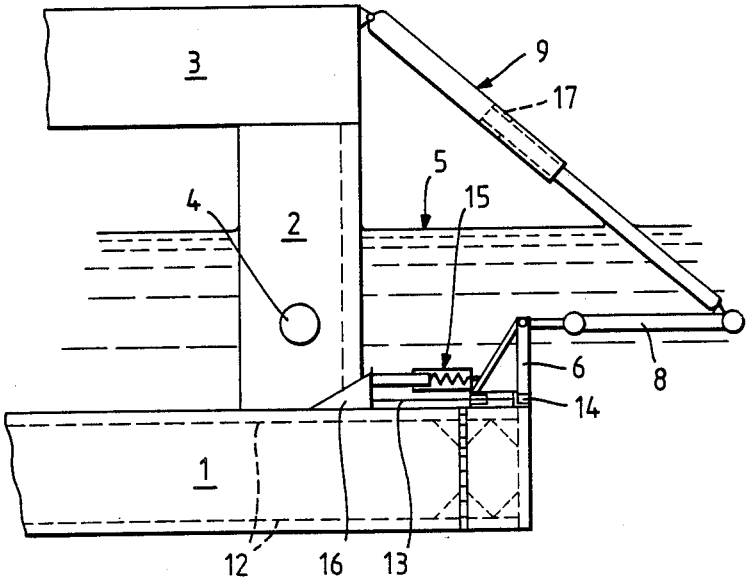
FIG. 3 shows a section similar to FIG. 2 of a second exemplifying embodiment of the invention.

FIG. 3 illustrates an exemplifying embodiment where the ability of the ice deflector 8 to absorb horizontal loads is increased. Here the framework 6 is guided in horizontal rails 13 by means of roller or sliding bearings 14. The framework 6 may be displaced along the rails 13 against the action of shock absorbing means 15, e.g. comprising a stiff spring and a suitable damping element. The means 15 permit absorbing the impact energy over a longer distance in order to reduce the forces acting on the deflector 8 and the platform structure. The movement of the shock absorbing means 15 is limited by means of a safety bracket 16. It will be understood that due to the resilient movement of the deflector 8, the stay 9 must change its length if the deflector is to remain generally horizontal. The stay 9 therefore is made telescopic and has an internal stopper 17 in order to limit its maximum length.

Figure 4:
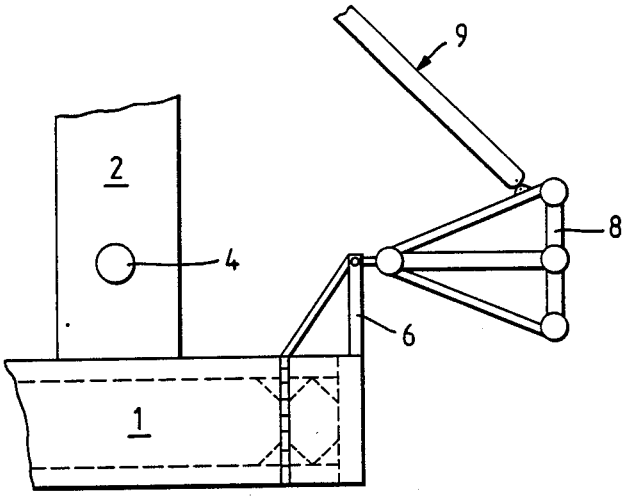
FIG. 4 shows a section similar to FIG. 2 of a third exemplifying embodiment of the invention.

In FIG. 4 an exemplifying embodiment is shown, where the deflector 8 has a certain vertical extent at the front. This embodiment makese it less likely that larger ice bodies, hitting the deflector relatively centrally, due to their larger draft would pivot in under the deflector and damage the stays 4 and/or the drill string.

Figure 5:
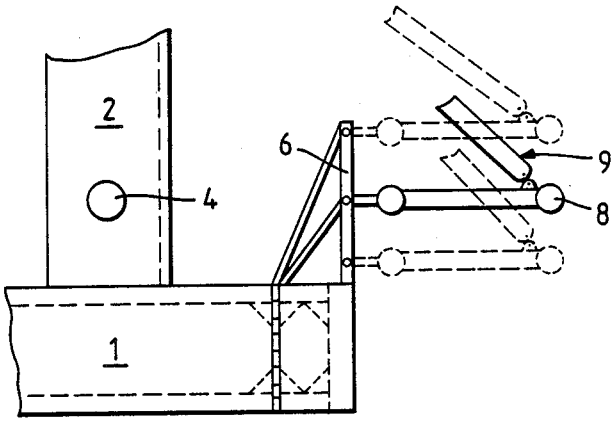
FIG. 5 shows a section similar to FIG. 2 of a fourth exemplifying embodiment of the invention.

Adaptation to varying ice conditions may also take place with the structure as shown in FIG. 5. Here the deflector 8 is vertically movable on the framework 6. Also in this case the stay 9 must be of variable length, for instance telescopic as shown in FIG. 3.

It will be understood that when the oil platform is in use, it is anchored so that the pontoons lie parallel to the prevalent current direction and so that the ice deflector 8 points against this direction. Ice bodies drifting against the deflector 8 will slide along it out to the side and further past along the outside of the respective pontoon, which on the outside has been made relatively smooth in order not to obstruct the passing of the ice. For this purpose, the anchoring lines may advantageously be taken out through fairleads in the bottom of the pontoons so that the ice is less likely to damage the fairleads and get angled in the anchoring lines.

Even though the invention has been described above with respect to certain exemplifying embodiments, it will be understood that the invetion is not limited to these, but may be varied within the scope of the following claims. Thus, the deflector need not be an absolute rigid structure, but may be made more flexible and concurrently somewhat more pointed so as to act inherently resilient without the deflection angle becoming too small to divert the ice bodies to the side.

I claim:

1. An arrangement in a semi-submersible oil platform, comprising two pontoons (1), columns (2) extending up from the pontoons for supporting a deck structure (3), and stays (4) extending transversely of the pontoons between at least some of the columns, characterized in that, between the pontoons (1), at one of the ends of each of the pontoons, a substantially submersed, plough-like, resiliently mounted protecting device (8) pivotally supported in attachment points (7) on the pontoons (1), and maintained in a generally horizontal position by means of a stay (9), which extends between the protecting device (8) and the deck structure (3), said protecting device (8) adapted to divert drifting objects away from the area between the pontoons.

2. An arrangement according to claim 1, characterized in that the protecting device (8) is connected to an existing supporting structure (12) of each pontoon (1) via a base (6).

3. An arrangement according to claim 2, characterized in that the base (6) is attached in a horizontally movable manner in rails (13) on the pontoons (1) and is connected to shock absorbing means (15).

4. An arrangement according to claim 1, characterized in that said stay (9) is telescopic and comprises a stopper (17) limiting its maximum length.

5. An arrangement according to claim 2, characterized in that the protecting device (8) is movable vertically on the base (6).

6. An arrangement according to claim 1, characterized in that the protecting device (8) is built mainly as a truss.

7. An arrangement according to claim 6, characterized in that the truss is three-dimensional and is higher at the front than at the back.

8. An arrangement according to claim 1, characterized in that the protecting device (8) is arranged generally at the level of the transverse stays (4) of the platform.

9. An arrangement according to claim 1, characterized in that the plough-like protecting device is resiliently mounted and has a deflection angle which is less than 120°.

10. An arrangement according to claim 2, characterized in that said stay (9) is telescopic and comprises a stopper (17) limiting its maximum length.

11. An arrangement according to claim 3, characterized in that said stay (9) is telescopic and comprises a stopper (17) limiting its maximum length.

12. An arrangement according to claim 2, characterized in that the protecting device (8) is movable vertically on the base (6).

13. An arrangement according to claim 3, characterized in that the protecting device (8) is movable vertically on the base (6).

14. An arrangement according to claim 4, characterized in that the protecting device (8) is movable vertically on the base (6).

15. An arrangement according to claim 10, characterized in that the protecting device (8) is movable vertically on the base (6).

16. An arrangement according to claim 11, characterized in that the protecting device (8) is movable vertically on the base (6).

17. An arrangment according to claim 1, wherein the stay (9) is jointed (10,11) to the deck structure (3) and the protecting device (8).

* * * * *